US009305681B2

(12) United States Patent
Toyama et al.

(10) Patent No.: US 9,305,681 B2
(45) Date of Patent: Apr. 5, 2016

(54) HIGH-VOLTAGE CONDUCTIVE PATH AND WIRING HARNESS

(75) Inventors: Eiichi Toyama, Shizuoka (JP); Tatsuya Oga, Shizuoka (JP); Shigemi Hashizawa, Shizuoka (JP); Eiji Shimochi, Aichi (JP)

(73) Assignee: Yazaki Corporation, Tokyo (JP)

( * ) Notice: Subject to any disclaimer, the term of this patent is extended or adjusted under 35 U.S.C. 154(b) by 62 days.

(21) Appl. No.: 13/980,828

(22) PCT Filed: Jan. 20, 2012

(86) PCT No.: PCT/JP2012/000344

§ 371 (c)(1),
(2), (4) Date: Oct. 3, 2013

(87) PCT Pub. No.: WO2012/098906

PCT Pub. Date: Jul. 26, 2012

(65) Prior Publication Data

US 2014/0014395 A1 Jan. 16, 2014

(30) Foreign Application Priority Data

Jan. 21, 2011 (JP) ..... 2011-010419

(51) Int. Cl.

| | |
|---|---|
| ***H01B 3/00*** | (2006.01) |
| ***H01B 9/00*** | (2006.01) |
| ***H01B 9/04*** | (2006.01) |
| *H01B 7/00* | (2006.01) |

(52) U.S. Cl.

CPC ..... *H01B 9/006* (2013.01); *H01B 9/04* (2013.01); *H01B 7/0045* (2013.01)

(58) Field of Classification Search

USPC ..... 174/36, 110 R, 110 AR–110 FC, 112, 174/105 R, 120 R, 120 C, 120 AR, 120 SR

See application file for complete search history.

(56) References Cited

U.S. PATENT DOCUMENTS

| | | | | |
|---|---|---|---|---|
| 2004/0099427 | A1 * | 5/2004 | Kihira | 174/35 C |
| 2004/0194996 | A1 * | 10/2004 | Ysbrand | 174/102 SC |
| 2004/0248434 | A1 | 12/2004 | Fujimura | |
| 2005/0011687 | A1 * | 1/2005 | Yamaguchi et al. | 180/65.1 |

(Continued)

FOREIGN PATENT DOCUMENTS

| | | | | |
|---|---|---|---|---|
| CN | 101351852 | A | 1/2009 | |
| EP | 1 113461 | A1 * | 7/2001 | H01B 9/04 |

(Continued)

OTHER PUBLICATIONS

International Search Report and Written Opinion dated Apr. 23, 2012, issued for PCT/JP2012/000344.

Office Action dated Sep. 17, 2015, issued for the corresponding Chinese patent application No. 201280006099.5 and English translation thereof.

*Primary Examiner* — William H Mayo, III

(74) *Attorney, Agent, or Firm* — Locke Lord LLP

(57) ABSTRACT

A wiring harness including a high-voltage conductive path having a shape holding function for holding a shape along an arrangement pathway. The high-voltage conductive path includes a positive electrode conductor, a first insulator extruded and arranged outside of the positive electrode conductor, a negative electrode arranged outside of the first insulator, a second insulator extruded and arranged outside of the negative electrode conductor, a shield member wrapped outside of the second insulator, first and second sheaths extruded and arranged outside of the shield member.

1 Claim, 4 Drawing Sheets

(56) References Cited

U.S. PATENT DOCUMENTS

| | | | | |
|---|---|---|---|---|
| 2006/0011376 | A1 * | 1/2006 | Van Den Berg et al. .. | 174/120 R |
| 2006/0272845 | A1 * | 12/2006 | Galey et al. ..... | 174/105 R |
| 2009/0283296 | A1 | 11/2009 | Shimosawa et al. | |

FOREIGN PATENT DOCUMENTS

| | | | | | |
|---|---|---|---|---|---|
| EP | 1113461 | A1 | | 7/2001 | |
| JP | 2005-197130 | A | * | 7/2005 | ..... H01B 11/18 |
| JP | 2010-012868 | A | | 1/2010 | |

* cited by examiner

HIGH-VOLTAGE CONDUCTIVE PATH AND WIRING HARNESS

TECHNICAL FIELD

The present invention relates to a high-voltage conductive path and a wiring harness.

BACKGROUND OF THE INVENTION

In the Patent Document 1, a hybrid vehicle and a wiring harness which is suitable for an electric vehicle are disclosed. The wiring harness disclosed in the Patent Document 1 connects a battery to an inverter unit, and has two high-voltage conductive paths, of which one high-voltage conductive path is a positive circuit and the other high-voltage conductive path is a negative circuit. The wiring harness has the two high-voltage conductive paths which are positioned parallel to each other, and is bent into a desired pathway.

PRIOR ART DOCUMENT

[Patent Document 1] Japanese Patent Application Publication No. 2010-12868

SUMMARY OF THE INVENTION

Problem to be Solved by the Invention

In the conventional wiring harness disclosed in the Patent Document 1, the high-voltage conductive path transmits drive-train electrical power. For this reason, a thickness of the high-voltage conductive path becomes large electric wire, and problems described below occur. More specifically, since two large electric wires should be arranged parallel to each other, large space is required. Furthermore, a bending direction of the wiring harness is constrained. As a result, pathway formation of the wiring harness is affected thereby.

Also, the conventional wiring harness has flexibility. For this reason, in general, when the pathway of the wiring harness is formed, a protector which is a molding product formed by using a die is used. As a result, material of the protector is able to be gotten at a cheap price. However, if cost of the die is increased, the protector becomes expensive product and cost thereof is increased. Furthermore, when the protector is manufactured in small quantities, cost of the protector may also be increased depending on cost of the die. If the cost of the protector is increased, overall cost of the wiring harness is increased.

In addition, lead time of commencement of work in the protector is long. For this reason, drawing of the die has to be created in a short time. As a result, troublesome design change is frequently performed, and design man-hours are increased. Further, when the design is changed, cost and time are increased. That is, avoiding the use of the protector is effective in the pathway formation of the wiring harness.

Accordingly, an object of the present invention is to provide a high-voltage conductive path and a wiring harness which can save space, and can easily perform a pathway formation, and can reduce cost.

Solution to Problem

In order to attain the above object, a high-voltage conductive path of the present invention includes one of a positive electrode conductor and a negative electrode conductor, a first insulator arranged outside of the one of the positive electrode conductor and the negative electrode conductor, an other of the positive electrode conductor and the negative electrode conductor arranged outside of the first insulator; and a second insulator arranged outside of the other of the positive electrode conductor and the negative electrode conductor. The one of the positive electrode conductor and the negative electrode conductor is a single core wire, and has a shape holding function for holding a shape along an arrangement pathway.

In a second aspect of a wiring harness of the present invention, the high-voltage conductive path described above is included.

According to the high-voltage conductive path of the present invention, a positive circuit and a negative circuit are constructed with one conductive path, namely one conductive path includes a positive circuit and a negative circuit. Furthermore, the wiring harness of the present invention includes the high-voltage conductive path. The positive or negative electrode conductor of the high-voltage conductive path is the single core wire, and has a shape holding function for holding a shape along an arrangement pathway.

In addition, the high-voltage conductive path of the present invention can add features described below. More specifically, the high-voltage conductive path may have a shield member arranged outside of the second insulator and a sheath arranged outside of the shield member. According to the high-voltage conductive path having the shield member and the sheath, great shield effect can be provided. The positive electrode conductor, the negative electrode conductor and the shield member are substantively constructed with three-layer structure.

The positive and negative electrode conductors are arranged in a concentric pattern. A positive current flows to the positive electrode conductor, and a negative current which flow in a direction opposed to a direction of the positive electrode conductor flows to the negative electrode conductor. As a result, magnetic fields caused by the positive electrode conductor and the negative electrode conductor are canceled, and magnetic filed of the high-voltage conductive path is not generated. That is, magnetic shield effect is provided. Further, the high-voltage conductive path and the wiring harness in the preset invention have no effect of noise on another conductive path close to the high-voltage conductive path or an apparatus thereto.

Advantageous Effects of the Invention

According to the present invention, space can be saved. Furthermore, a pathway formation can be easily performed and cost of the high-voltage conductive path can be reduced.

DESCRIPTION OF THE PREFERRED EMBODIMENTS

Figure 1A:
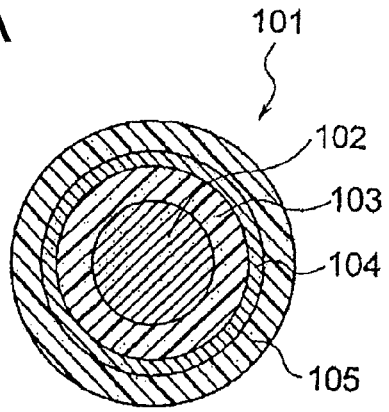
FIG. 1A is a configuration diagram of a first embodiment of a high-voltage conductive path in the present invention.
Figure 1B:
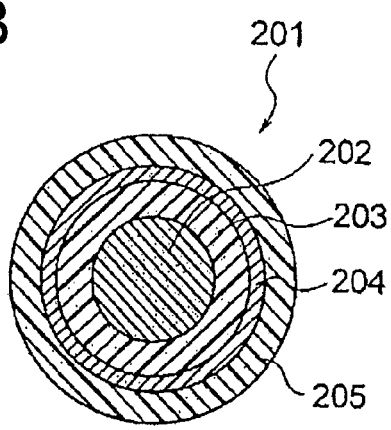
FIG. 1B is a configuration diagram of a second embodiment of the high-voltage conductive path in the present invention.
Figure 1C:
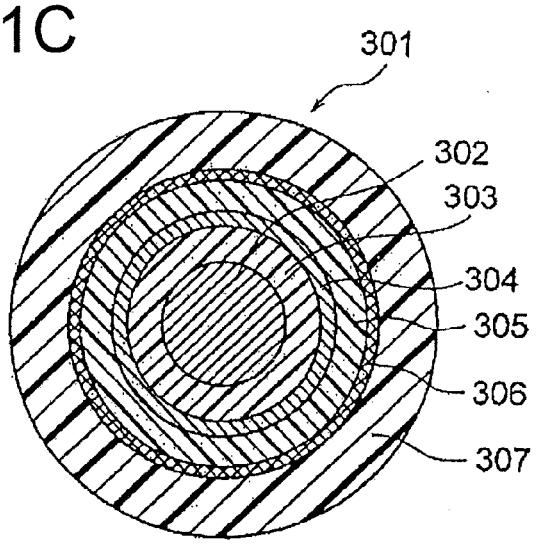
FIG. 1C is a configuration diagram of a third embodiment of the high-voltage conductive path in the present invention.
Figure 1D:
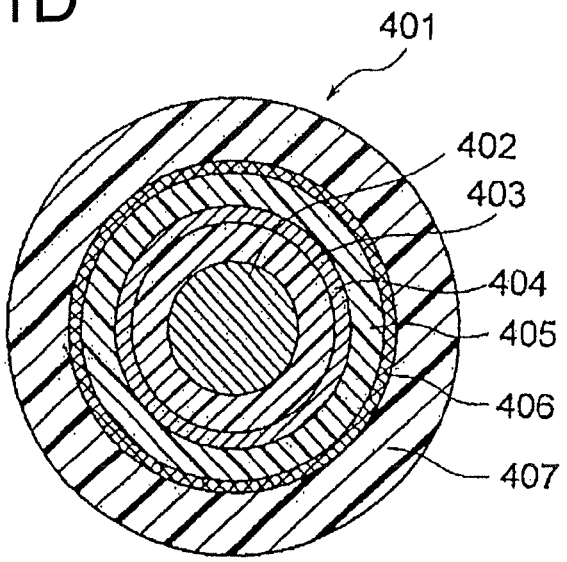
FIG. 1D is a configuration diagram of a fourth embodiment of the high-voltage conductive path in the present invention.

A high-voltage conductive path according to embodiments of the present invention will be explained with reference to the drawings. FIGS. 1A to 1D are drawings showing embodiments of the high-voltage conductive path of the present invention. FIG. 1A is a configuration diagram of a first embodiment, and FIG. 1B is a configuration diagram of a second embodiment, and FIG. 1C is a configuration diagram of a third embodiment, and FIG. 1D is a configuration diagram of a fourth embodiment.

In the high-voltage conductive path of the present invention, a positive circuit and a negative circuit are constructed with one conductive path. Further, the high-voltage conductive path has arbitrary shielding characteristic. Furthermore, a wiring harness of the present invention has such high-voltage conductive path. Hereafter, configuration of the high-voltage conductive path will be explained with reference to FIGS. 1A to 1D.

As shown in FIG. 1A, the high-voltage conductive path 101 has a positive electrode conductor 102, a first insulator 103 arranged outside of the positive electrode conductor 102, a negative electrode conductor 104 arranged outside of the first insulator 103, and a second insulator 105 arranged outside of the negative electrode conductor 104. The positive electrode conductor 102 of the high-voltage conductive path 101 is a single core wire, and is located in the center of the high-voltage conductive path 101. Furthermore, the positive electrode conductor 102 has a shape holding function (referring to embodiments described below) for holding shape along an arrangement pathwayway.

As shown in FIG. 1B, the high-voltage conductive path 201 has a negative electrode conductor 202, a first insulator 203 arranged outside of the negative electrode conductor 202, a positive electrode conductor 204 arranged outside of the first insulator 203, and a second insulator 205 arranged outside of the positive electrode conductor 204. The negative electrode conductor 202 of the high-voltage conductive path 201 is a single core wire, and is located in the center of the high-voltage conductive path 201. Furthermore, the negative electrode conductor 202 has a shape holding function (referring to embodiments described below) for holding shape along an arrangement pathwayway.

As shown in FIG. 1C, the high-voltage conductive path 301 has a positive electrode conductor 302, a first insulator 303 arranged outside of the positive electrode conductor 302, a negative electrode conductor 304 arranged outside of the first insulator 303, a second insulator 305 arranged outside of the negative electrode conductor 304, a shield member 306 arranged outside of the second insulator 305, and a sheath 307. The positive electrode conductor 302 of the high-voltage conductive path 301 is a single core wire, and is located in the center of the high-voltage conductive path 301. Furthermore, the positive electrode conductor 302 has a shape holding function (referring to embodiments described below) for holding shape along an arrangement pathwayway. The high-voltage conductive path 301 has a shielding function.

As shown in FIG. 1D, the high-voltage conductive path 401 has a negative electrode conductor 402, a first insulator 403 arranged outside of the negative electrode conductor 402, a positive electrode conductor 404 arranged outside of the first insulator 403, a second insulator 405 arranged outside of the positive electrode conductor 404, a shield member 406, and a sheath 407. The negative electrode conductor 402 of the high-voltage conductive path 401 is a single core wire, and is located in the center of the high-voltage conductive path 401. Furthermore, the negative electrode conductor 402 has a shape holding function (referring to embodiments described below) for holding shape along an arrangement pathwayway. The high-voltage conductive path 401 has a shielding function.

Embodiments

Figure 2A:
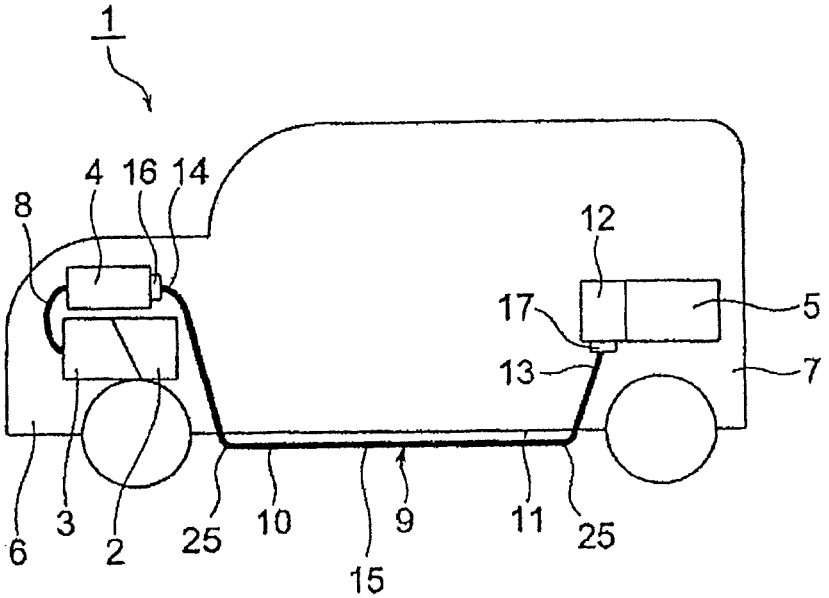
FIG. 2A is a schematic diagram showing a configuration state of a wiring harness in the present invention.
Figure 2B:
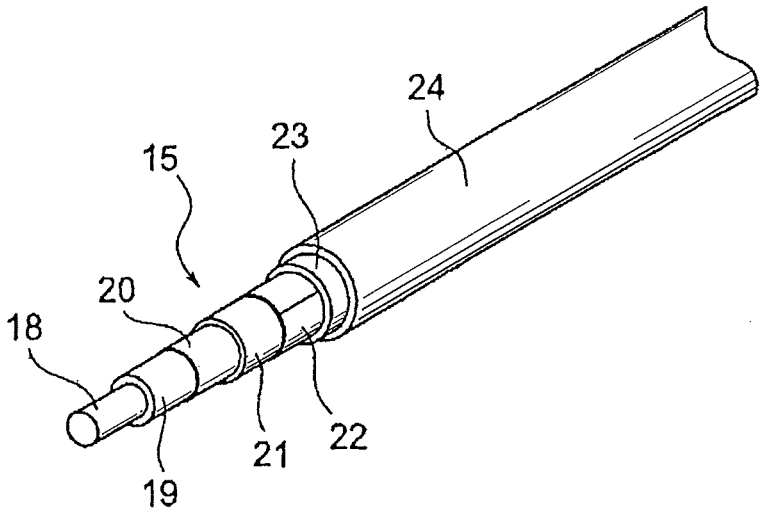
FIG. 2B is a configuration diagram of the high-voltage conductive path in the present invention.
Figure 3:
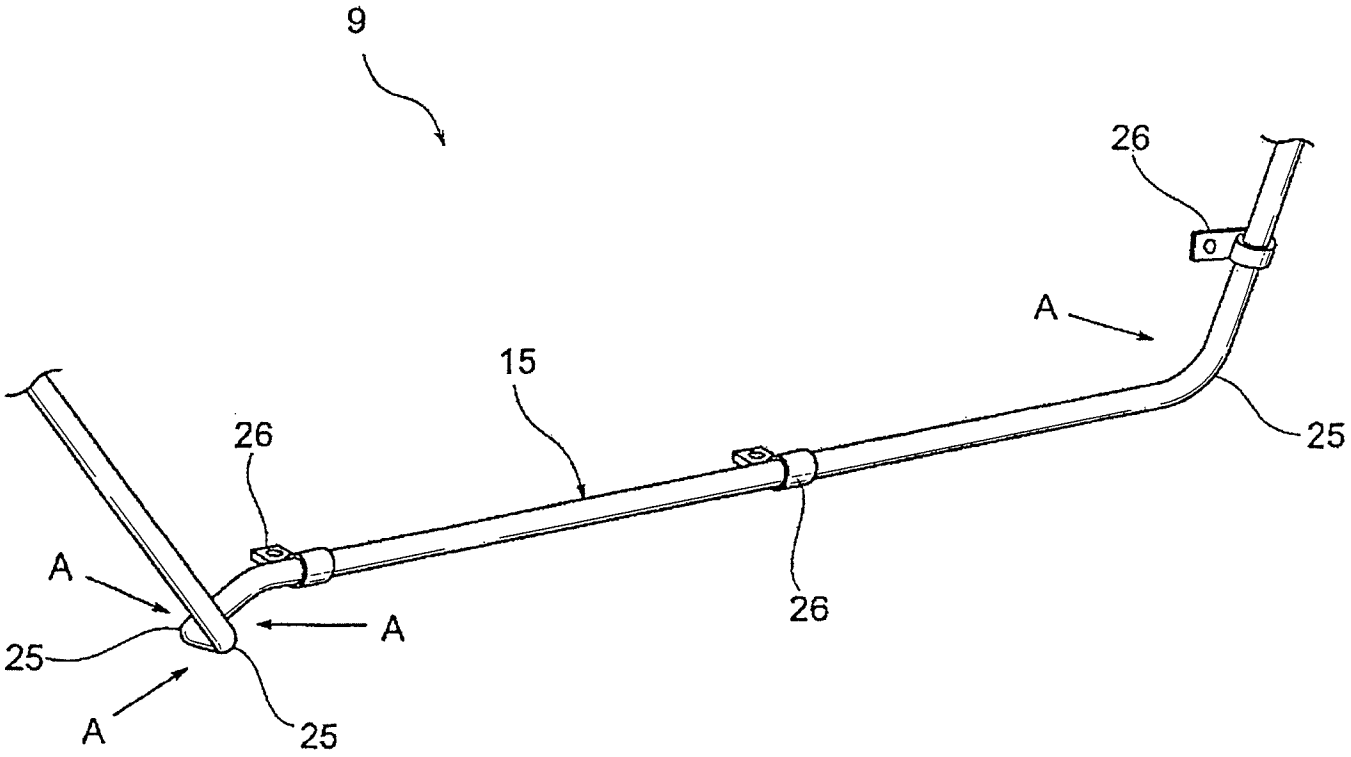
FIG. 3 is a perspective view showing a state in which a flexion is formed by bending the high-voltage conductive path with a bender machine.

One embodiment of the present invention will be explained with reference to the drawings. FIG. 2A is a schematic diagram showing a configuration state of the wiring harness of the present invention, and FIG. 2B is a configuration diagram of the high-voltage conductive path of the present invention. FIG. 3 is a perspective view showing a state in which a flexion is formed by bending the high-voltage conductive path with a bender machine.

In this embodiment of the present invention, one example applying the wiring harness of the present invention to a hybrid vehicle or electric vehicle will be explained.

The reference numeral 1 in FIG. 2 shows a hybrid vehicle. The hybrid vehicle 1 is driven by mixing two powers of an engine 2 and a motor unit 3. An electric power from a battery 5 or battery pack is supplied to the motor unite 3 through an inverter unit 4. The engine 2, the motor unit 3, and the inverter unit 4 are mounted on an engine room 6 which is located at a position in which a front wheel is arranged. The battery 5 is mounted on vehicle rear portion 7 in which a rear wheel is arranged. The battery may be mounted in a vehicle room which is arranged on the back of the engine room 6.

The motor unit 3 and the inverter unit 4 are connected to a common high-voltage wiring harness 8. The battery 5 and the inverter unit 4 are connected to a wiring harness 9 of the present invention. The wiring harness 9 is constructed for used in high-voltage, and a middle portion 10 of the wiring harness 9 is arranged in a ground side of a vehicle under floor 11. The vehicle under floor 11 is a well-known body and a panel member. A through hole (ellipsis of numeral) penetrates through the vehicle under floor 11 at a predetermined position.

The wring harness 9 and the battery 5 are connected via a junction block 12 arranged in the battery 5. A rear end 13 of the wiring harness 9 is connected to the junction block 12. The rear end 13 of the wiring harness 9 is arranged on a floor which is an interior room of the vehicle. On the floor, a front end 14 of the wiring harness 9 is arranged. The front end 14 of the wiring harness 9 is connected to the inverter unit 4. The wiring harness 9 is arranged so that the middle portion 10 is located along the vehicle under floor 11.

Supplement explanation in the embodiment of the present invention will be described. The motor unit 3 includes a motor and a generator. Further, the inverter unit 4 includes an inverter and a converter. The motor unit 3 is formed as a motor assembly including a shield case. Also, the inverter unit 4 is formed as an inverter assembly including the shield case. The battery 5 is Ni-MH battery types or Li-ion types, and is modularized. Furthermore, an electric storage device such as a capacitor can be used. The battery 5 is not limited when it is available for the hybrid vehicle 1 or the electric vehicle.

Hereafter, structure and composition of the wiring harness 9 will be explained.

The wiring harness 9 has a high-voltage conductive path 15, an inverter side connection 16 and a battery side connection 17. The high-voltage conductive path 15 has a shape holding function for holding shape along an arrangement pathwayway. The inverter side connection 16 is arranged in one end of the high-voltage conductive path 15, and electrically connected to the inverter unit 4. The battery side connection 17 is arranged in another end of the high-voltage conductive path 15, and electrically connected to the junction block 12. Construction of the wiring harness 9 described above is one example. For example, another high-voltage conductive path including flexibility may be arranged between the high-voltage conductive path 15 and the inverter side connection 16 or between the high-voltage conductive path 15 and the battery side connection 17.

The high-voltage conductive path 15 has a stiffness property which can hold a shape along the arrangement pathwayway of the wiring harness 9. More specifically, when the high-voltage conductive path 15 is bent from a straight line state, the shape of the bent high-voltage conductive path 15 can be maintained because the high-voltage conductive path 15 has the stiffness property. This stiffness property is mainly a stiffness property of the positive electrode conductor 18 described below.

The high-voltage conductive path 15 has a positive electrode conductor 18, a first insulator 19, a negative electrode conductor 20, a second insulator 21, a shield member 22, a first sheath 23 and a second sheath 24. The first insulator 19 is extruded outside of the positive electrode conductor 18 and molded. The second insulator 21 is extruded outside of the negative electrode conductor 20 and molded. The shield member 22 is wound outside of the second insulator 21. The first sheath 23 and the second sheath 24 are extruded outside of the shield member 22 and molded.

The high-voltage conductive path 15 of the embodiment of the present invention corresponds to the high-voltage conductive path 301 in FIG. 1C, and is constructed. The high-voltage conductive path 15 may corresponds to the high-voltage conductive paths 101, 201, or 401.

The positive electrode conductor 18 is a single core made of an aluminum or aluminum alloy, and formed in a round shape. The positive electrode conductor 18 may be a single core formed in a box shape or bus bar shape. Furthermore, a stranded conductor may be used as the positive electrode conductor 18 if the stranded conductor can have a stiffness property for holding the above shape. Regarding to material, it is not limited to the above material. That is, the positive electrode conductor 18 may be made of copper or copper alloy. In the embodiment of the present invention, the positive electrode conductor 18 is made of aluminum having inexpensive and lightweight advantages.

The first insulator 19 coats the positive electrode conductor 18, and is formed by extruding common-known resin material.

The negative electrode conductor 20 is formed into a tubular shape, and surrounds the first insulator 19. Further, the negative electrode conductor 20 is coaxially arranged with the positive electrode conductor 18. Furthermore, the negative electrode conductor 20 is formed in the same size as a size of the positive electrode conductor 18 or in the size larger than the size of the positive electrode conductor 18. More specifically, when the size of the positive electrode conductor 18 is 15 sq, the size of the negative electrode conductor 20 is equal to or more than 15 sq. As the reason for such size, there is an advantage which can improve electrical stability.

Material of the negative electrode conductor 20 is selected according to material of the positive electrode conductor 18, cost and the like. In the embodiment of the present invention, the negative electrode conductor 20 is made of aluminum or aluminum alloy, but it is not limited thereto. The negative electrode conductor 20 may be made of copper or copper alloy.

The second insulator 21 coats the negative electrode conductor 20, and is formed by extruding common-known resin material.

The shield member 22 is an electromagnetic shield member for shielding electromagnetic wave, and arranged between the second insulator 21 and the first sheath 23. Further, the shield member 22 is made of conductive metallic foil, and formed into a tubular shape.

The shield member 22 includes the metallic foil in the embodiment of the present invention, but it is not limited thereto. For example, a braided wire having a plurality of extra-fine element wires may be used. The braided wire has conductive property and is formed in a tubular shape. The metallic foil can greatly reduce weight compared with the braided wire.

The first sheath 23 and the second sheath 24 are common-known sheaths, respectively. Furthermore, the first sheath 23 and the second sheath 24 are selected from resin material having various good properties such as a heat resistance property, an abrasion resistance property, a weathering performance, an impact resistance and extrusion molding performance, and extruded and formed. A surface of the second sheath 24 corresponds to an outer surface of the high-voltage conductive path 15. The first and second sheaths 23 and 24 are formed to protect the high-voltage conductive path 15 against stone and water splashes. Furthermore, the first and second sheaths 23 and 24 are formed so that an exterior member is not required. If the exterior member is used, the high-voltage conductive path 15 is protected by the exterior member such as a corrugated tube formed in a tubular shape.

The sheath of the embodiment of the present invention is two-layer structure. More specifically, in the high-voltage conductive path 15 of the present invention, the first and second sheaths 23 and 24 are provided. The first sheath 23 located on the inside of the second sheath 24 is made of PE (polyethylene) material in the embodiment of the present invention. On the other hand, the second sheath 24 located on the outside of the first sheath 23 is made of PP (polypropylene) material in the embodiment of the present invention. The second sheath 24 can enhance the capability to protect the high-voltage conductive path 15 against stone and water splashes. By using the above PP, reliability for external force can be improved. In the embodiment of the present invention, two-layer structure such the first and second sheathes 23 and 24 is used because protection function can be improved, but it is not limited thereto. That is, one-layer structure may be used.

As shown in FIG. 2B, the high-voltage conductive path 15 consists of the positive electrode conductor 18, the negative electrode conductor 29 and the shield member 22, and a conductive portion thereof is constructed with coaxial three-layer structure.

In the high-voltage conductive path 15, the positive and negative circuits are constructed with one conductor. For this reason, space can be saved when the high-voltage conductive path 15 is arranged, and weight of the high-voltage conductive path 15 can be reduced. Furthermore, in a process assembling a wiring harness, man-hour can be reduced because two conductors are changed to one conductor. Additionally, the use of conductor and insulator can be reduced. Thus, material cost can be reduced.

Also, the positive electrode conductor 18 is surrounded with the negative electrode conductor 20. Further, current of the positive electrode conductor 18 flows in an opposite direction of current of the negative electrode conductor 20, namely, the current direction of the positive electrode conductor 18 is opposite to the current direction of the negative electrode conductor 20. Thus, magnetic fields caused by the positive electrode conductor and the negative electrode conductor are canceled, and great shield effect can be provided. Furthermore, noise leakage against an exterior can be removed. In addition, risk of glitch can be reduced.

The high-voltage conductive path 15 is produced as mentioned above. Thereafter, the high-voltage conductive path 15 is bent at a predetermined position by using a bender machine (not shown). For example if the high-voltage conductive path 15 is bent in the arrow A as shown in FIG. 3, a flexion 25 is formed as shown in FIGS. 2 and 3. When the flexion 25 is formed, the high-voltage conductive path 15 is held with a shape along the arrangement pathway of the wiring harness 9. Furthermore, when the flexion 25 is provided, the high-voltage conducing path 15 can maintain the bent shape without returning to an original shape by the stiffness property of especially the positive electrode conductor 18.

The reference numeral 26 in FIG. 3 shows a fixing clamp. The small clamp 26 is enough to be fixed in other objects because the high-voltage conductive path 15 can maintain the shape.

The bender machine not shown in drawings can be provided in various positions. For example, the bender machine may be arranged in a manufacturing factory of wiring harness or an arranging factory of wiring harness. It is desirable to decide the installation position of the bender machine depending on workability and the like.

In FIGS. 2A and 2B, the inverter side connection 16 respectively connect the positive and negative electrode conductors 18 and 20 of the high-voltage conductive path 15 to the positive and negative circuits of the inverter unit 4. Furthermore, the inverter side connection 16 connects the shield member 22 of the high-voltage conductive path 15 to the shield case of the inverter unit 4. Preferably, the invert side connection 16 is constructed with a shield connector structure or shield connector configuration. Also, the battery side connection 17 is constructed in the same manner as the inverter side connection 16. So the explanation of the battery side connection 17 is left out of this description.

As explained with reference to FIGS. 2 and 3, the positive and negative circuits of the high-voltage conductive path 15 are constructed with single conductive path. Furthermore, the wiring harness 9 includes the above high-voltage conductive path 15. Thus, space can be saved.

Furthermore, the high-voltage conductive path 15 has the positive electrode conductor 18 of single core wire. Therefore, a shape can be held along an arrangement pathwayway by the positive electrode conductor 18. In addition, formation of the pathway can be easily performed, and cost can be reduced.

Additionally, it is not required to use a protector as a pathway holding member for maintaining a shape or line in the wiring harness 9, and a resin molding die is not necessary. Furthermore, in the wiring harness 9, the first and second sheaths 23 and 24 of the high-voltage conductive path 15 function as an exterior member. Thus, it is not necessary to use the exterior member in the high-voltage conductive path 15. As a result, the inexpensive wiring harness 9 can be provided, and cost of the wiring harness 9 can be reduced.

According to the wiring harness 9 of the present invention, the flexion 25 is formed with the bender machine. For this reason, pathway formation can be performed with programming. As a result, various processing periods can be reduced. Furthermore, design changes can be easily performed, and time of design process can be reduced. In addition, according to cost of the design changes, as compared with a programming change and a die change, cost of the programming change is very cheap. Thus, cost of the wiring harness 9 can be reduced.

The present invention can be implemented with various modifications made thereto within the scope of the present invention.

REFERENCE SIGNS

1 hybrid vehicle
2 engine
3 motor unit
4 inverter unit
5 battery
6 engine room
7 vehicle rear
8 high-voltage wiring harness
9 wiring harness
10 middle portion
11 vehicle under floor
12 junction block
13 rear end
14 front end
15 high-voltage conductive path
16 inverter side connection
17 battery side connection
18 positive electrode conductor
(one of the positive electrode conductor and the negative electrode conductor)
19 first insulator
20 negative electrode conductor
(the other of the positive electrode conductor and the negative electrode conductor)
21 second insulator
22 shield member
23 first sheath
24 second sheath
25 flexion
26 clamp

What is claimed is:

1. A high-voltage conductive path comprising:

one of a positive electrode conductor and a negative electrode conductor;

a first insulator arranged outside of the one of the positive electrode conductor and the negative electrode conductor;

an other of the positive electrode conductor and the negative electrode conductor arranged outside of the first insulator; and a second insulator arranged outside of the other of the positive electrode conductor and the negative electrode conductor, wherein the one of the positive electrode conductor and the negative electrode conductor is a single core wire, and has a shape holding function for holding a shape along an arrangement pathway, wherein the high-voltage conductive path includes a shield member wound outside of the second insulator, and wherein the high-voltage conductive path is used in a wiring harness, and is not provided with a protector.

* * * * *